US011760515B2

(12) United States Patent
Finzo et al.

(10) Patent No.: US 11,760,515 B2
(45) Date of Patent: Sep. 19, 2023

(54) CONTROL MECHANISM FOR TILTING MACHINE OF STRAPPING MACHINE

(71) Applicant: ITATOOLS S.R.L., Origgio (IT)

(72) Inventors: Alessandro Finzo, Würenlos (CH); Flavio Finzo, Würenlos (CH)

(73) Assignee: ITATOOLS S.R.L., Origgio (IT)

( * ) Notice: Subject to any disclaimer, the term of this patent is extended or adjusted under 35 U.S.C. 154(b) by 65 days.

(21) Appl. No.: 17/454,429

(22) Filed: Nov. 10, 2021

(65) Prior Publication Data

US 2022/0144463 A1 May 12, 2022

(30) Foreign Application Priority Data

Nov. 12, 2020 (IT) ..... 102020000027110

(51) Int. Cl.
*B65B 13/22* (2006.01)
*B65B 13/18* (2006.01)
(Continued)

(52) U.S. Cl.
CPC ..... *B65B 13/22* (2013.01); *B65B 13/025* (2013.01); *B65B 13/185* (2013.01); *B65B 13/187* (2013.01); *B65B 13/322* (2013.01)

(58) Field of Classification Search
CPC ..... B65B 13/025; B65B 13/18; B65B 13/185; B65B 13/187; B65B 13/22; B65B 13/32; B65B 13/322; B65B 13/327
(Continued)

(56) References Cited

U.S. PATENT DOCUMENTS 6,109,325 A * 8/2000 Chang ..... B65B 13/025 100/32
2011/0056392 A1 3/2011 Neeser et al.
(Continued)

FOREIGN PATENT DOCUMENTS

EP 2285691 A1 2/2011
WO 2009129636 A1 10/2009

OTHER PUBLICATIONS

Italian Search Report issued for corresponding Italian Patent Application No. 102020000027110, completed on Jul. 19, 2021, six pages.

*Primary Examiner* — Jimmy T Nguyen
(74) *Attorney, Agent, or Firm* — Vorys, Sater, Seymour and Pease LLP

(57) ABSTRACT

Strapping machine tilting device control mechanism including epicyclic transmission having a main axis and an internal crown, intermediate gears and an external crown, a pulling mechanism connected to intermediate gears to a tilting device tensioning roller to transmit movement of the gears around to the main axis to the tensioning roller, a tensioning wheel centered with the main axis constrained to the inner crown and connected to a strapping machine tensioning assembly to transmit tensioning wheel movement, a locking device connected to the external crown, control device to interact with a strapping machine actuation lever connected to the locking device to transmit actuation lever movement to the locking device defining rest and operating positions, the locking device includes: ring centered with the main axis and integral with the external crown, and torsional spring between the tilting device and control device, centered with the main axis to tighten around the ring.

14 Claims, 4 Drawing Sheets

(51) Int. Cl.
*B65B 13/02* (2006.01)
*B65B 13/32* (2006.01)

(58) Field of Classification Search
USPC ..... 100/29, 32
See application file for complete search history.

(56) References Cited

U.S. PATENT DOCUMENTS

| | | | | |
|---|---|---|---|---|
| 2015/0246739 | A1* | 9/2015 | Finzo | B65B 13/187<br>100/32 |
| 2018/0194497 | A1 | 7/2018 | Finzo et al. | |
| 2018/0273219 | A1* | 9/2018 | Yu Chen | B65B 13/025 |
| 2020/0339290 | A1 | 10/2020 | Finzo | |

* cited by examiner

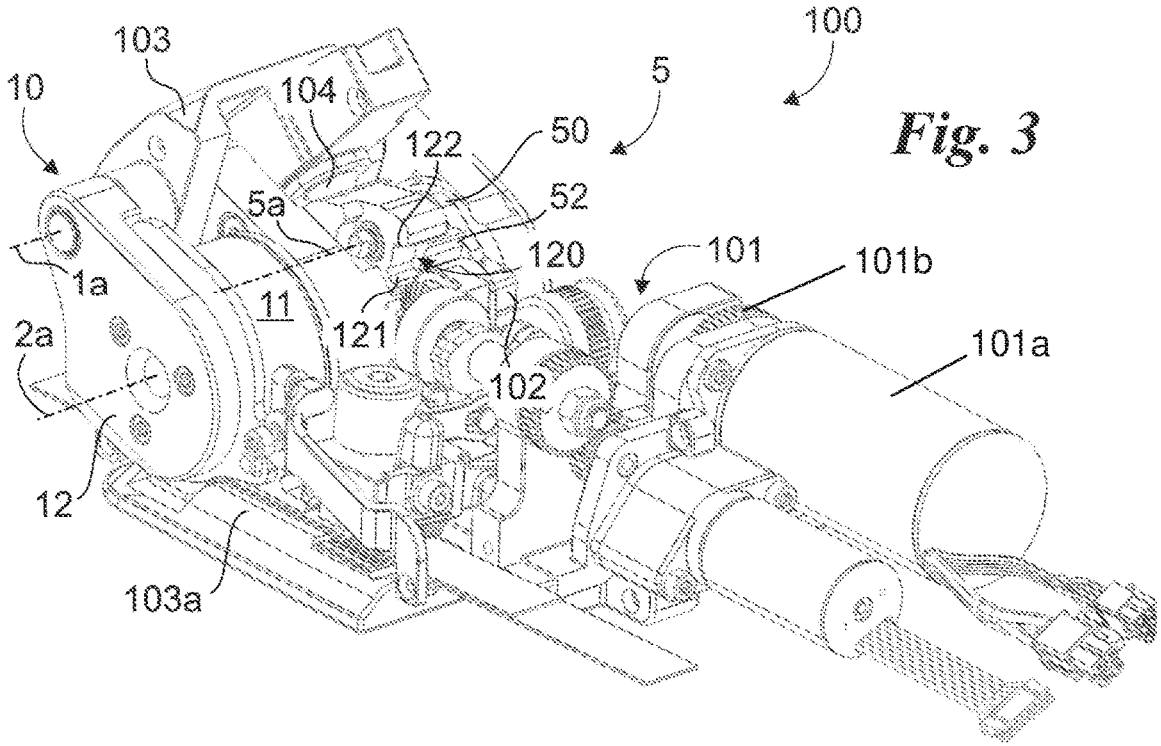
*Fig. 3*
*Fig. 4*
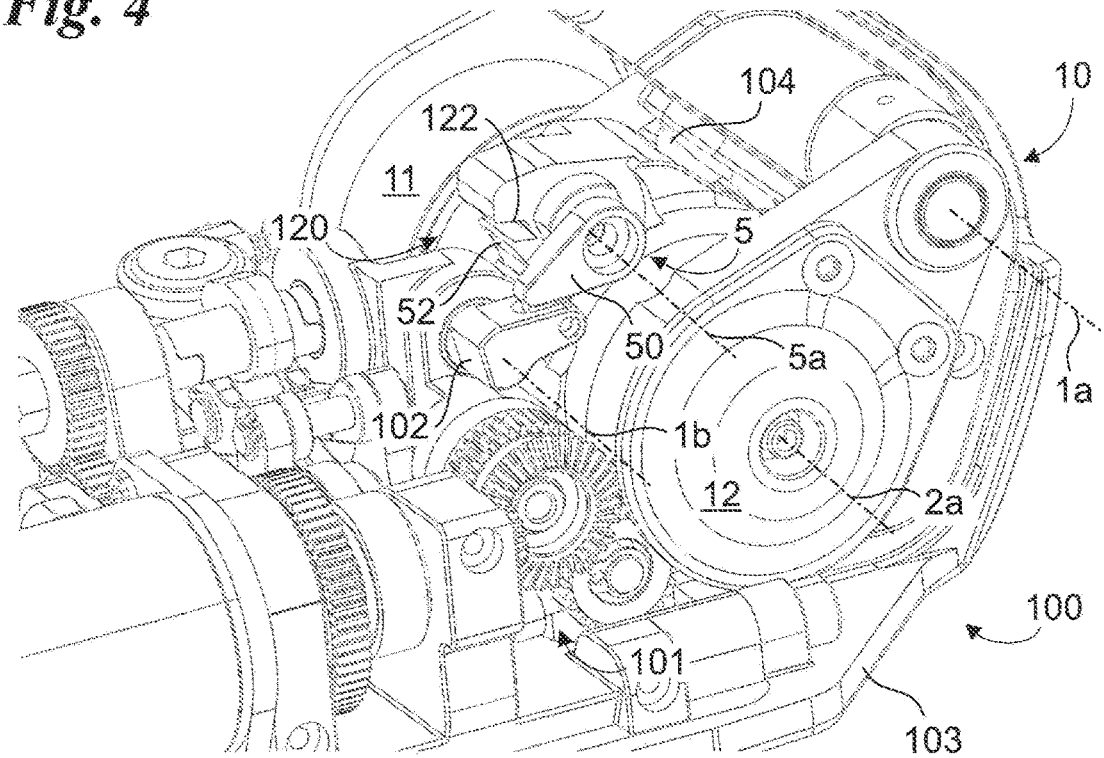

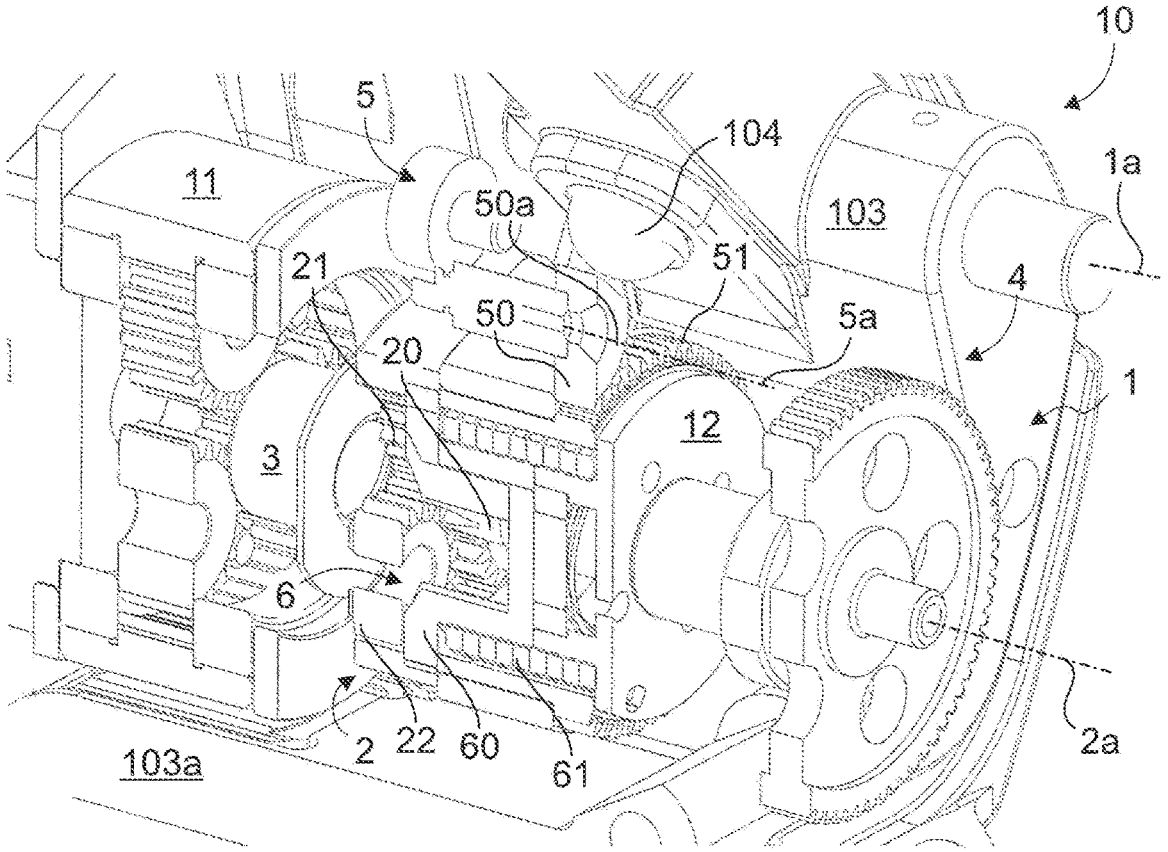
*Fig. 6*
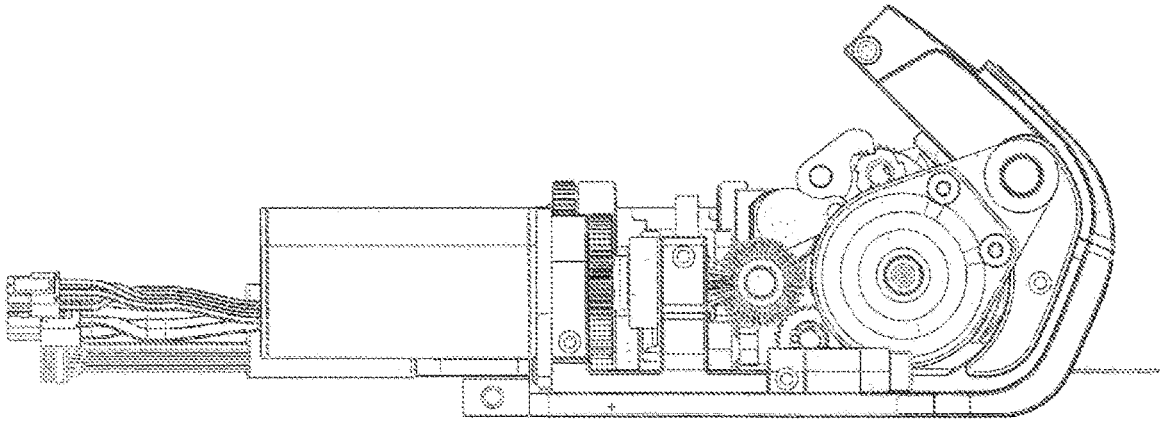
*Fig. 7 (Known Art)*

CONTROL MECHANISM FOR TILTING MACHINE OF STRAPPING MACHINE

FIELD OF THE INVENTION

The present invention relates to a control mechanism for tilting device of strapping machine of the type comprising: an epicyclic transmission defining a main axis (a) and comprising an inner crown, a plurality of intermediate gears and an external crown, a pulling mechanism operatively connected to the intermediate gears and to a tensioning roller of the tilting device and configured to transmit the movement of the internal gears around the main axis (a) to the tensioning roller, a tensioning wheel centred with respect to the main axis (a) integrally constrained to the inner crown and operatively connected to a tensioning assembly of the strapping machine in such a way as to transmit the movement of the tensioning wheel imposed by the tensioning assembly to the inner crown, a locking device operationally connected to the external crown and configured to realize at least: a lock condition in which the locking device and the external crown are coupled in such a way as to create a constraint joint, an unlock condition wherein at least part of the locking device and the external crown are decoupled in such a way as to be movable independently, a control device configured to interact with an actuation lever of the strapping device, operatively connected to the locking device in such a way as to transmit at least part of the movement of the actuation lever to the locking device, and defining at least one resting position and a first actuation position wherein the control device has performed a first predetermined movement imposed by the actuation lever.

DESCRIPTION OF THE PRIOR ART

In particular, the present invention relates to a control mechanism for tilting device of an at least semi-automatic strapping machine, preferably automatic, suitable for allowing the common operations of tensioning a strap and joining by welding two edges of said strap.

As is known, in the sector relating to the transport and packaging of goods, for example with polymeric films of different thicknesses or through simple cardboard containers, polymeric tapes or bands, called straps, are used in order to seal or close the packaging safely of the aforementioned goods.

In order to perform their function, the straps are tensioned on the packaging and joined, at the ends, in such a way as to lock the same straps on the pack.

The tensioning and welding phases, in particular, cannot be carried out by hand by an operator, but require specific tools called strapping machines.

Strapping machines are automatic or semi-automatic machines used to seal a certain product, as mentioned, for transport purposes and which perform their tensioning action both vertically and horizontally.

Essentially, strapping machines include at least one welding assembly and one tensioning assembly.

The welding assembly includes a mechanism suitable for locking at least two edges of strap in such a way as to join them at a fixed point. The joining is therefore usually carried out by subjecting the blocked edges to a continuous kinematic action capable of generating friction and through which the heat necessary for the melting and joining of the strip is produced.

At the end of the joining operation, the operator can unlock the mechanism, and therefore also the strap, through a mechanical lever or, more rarely, through an electronic button.

The tensioning assembly, on the other hand, includes a tilting element around an axis arranged in an advanced position, on the strapping machine, and precisely called the tilting device.

The action locks by friction at least two edges of the strap and subjects them to an opposite tensioning force, made by means of a rotating roller, in such a way that the portions of the strap slide one on top of the other until they reach the entire belt of a predetermined state of tension.

This operation is also carried out thanks to the command of an operator, usually at least one electronic button, who gives the order of locking and tensioning the strap. The mechanism of the tilting device includes a plurality of transmission elements which are adapted to transmit motion from a motor to the tilting device and from the tilting device to the tensioning roller.

Therefore, conventionally, the strapping machine comprises at least one driving motor adapted to drive the welding unit, the tensioning assembly and a mechanical lever, or servomotor, for the release of the strap once the joining is completed.

The known art described includes some important drawbacks.

In particular, the actual tilting devices as they comprise epicyclic gears are operated by means of a lever system which moves the tilting device around its own axis and at the same time provides for the locking of the outer ring of the epicyclic gear.

The external crown must, in this configuration, be provided with double toothing in such a way that the locking can be carried out by locking an external gear in contact with the external toothing of the external crown of the epicyclic mechanism.

The locking gear is in turn blocked by a toothed wheel which rotation is prevented, as shown in FIG. 7, by a control lever which interferes with the toothed wheel once the control lever is operated.

This system, in addition to requiring a double toothing, internal and external, on the external crown of the epicyclic mechanism, involves an inefficient locking of the tensioning roller. In fact, when the operating lever moves the control lever, the toothed wheel is not immediately stopped, in its travel, until the tip of the control lever comes into contact with the step of the toothing.

Therefore, the tensioning roller can perform, during the release phase of the action, a rotation given by the slippage between the control lever and the toothed wheel which leads to an irregular consumption of the control lever with consequent degradation and may, on some occasions, also involve the involuntary deformation of the strap tensioning area.

SUMMARY OF THE INVENTION

In this situation, the technical task underlying the present invention is to devise a control mechanism for tilting device of strapping machine capable of substantially obviating at least part of the aforementioned drawbacks.

Within the scope of said technical task, an important object of the invention is to obtain a control mechanism for tilting device of strapping machine which allows to increase the efficiency of the tension release of the tensioning roller.

Furthermore, within the scope of said technical task, it is an important object of the invention to obtain a control mechanism for a strapping device which allows to reduce or completely eliminate the possibility of slippage between the control lever and the locking gear.

Another important object of the invention is to provide a control mechanism for a strapping device which is capable of increasing the response speed of the tilting device to the commands given by a user to the strapping machine which involve locking or movement of the tilting device.

In conclusion, a further aim of the invention is to provide a control mechanism for tilting device of strapping machine which allows to avoid the use of double-toothed crowns, which is simple and can be subject to rapid maintenance.

The technical task and the specified aims are achieved by a control mechanism for tilting device of strapping machine comprising: an epicyclic transmission defining a main axis (a) and comprising an inner crown, a plurality of intermediate gears and an external crown, a pulling mechanism operatively connected to the intermediate gears and to a tensioning roller of the tilting device and configured to transmit the movement of the intermediate gears around the main axis (a) to the tensioning roller, a tensioning wheel centred with respect to the main axis (a) integrally constrained to the inner crown and operatively connected to a tensioning assembly of the strapping machine in such a way as to transmit the movement of the tensioning wheel imposed by the tensioning assembly to the inner crown, a locking device operationally connected to the external crown and configured to realize at least: a lock condition in which the locking device and the external crown are coupled in such a way as to create a constraint joint, an unlock condition wherein at least part of the locking device and the external crown are decoupled in such a way as to be movable independently, a control device configured to interact with an actuation lever of the strapping device, operatively connected to the locking device in such a way as to transmit at least part of the movement of the actuation lever to the locking device, and defining at least one resting position and a first actuation position wherein the control device has performed a first predetermined movement imposed by the actuation lever, the locking device including: a ring centred with respect to said main axis and integral with the external crown, and a torsional spring constrained between a fixed point of the tilting device and the control device, centred with respect to the main axis and configured to tighten around the ring to realize the lock condition or widen around the ring in such a way as to realize said release condition.

BRIEF DESCRIPTION OF THE DRAWINGS

The characteristics and advantages of the invention are clarified below by the detailed description of preferred embodiments of the invention, with reference to the accompanying drawings, in which:

the FIG. 1 shows an exploded view of a control mechanism for tilting device of strapping machine according to the invention wherein is also visible the tensioning roller and the reduction unit from a transporter roller device;

Figure 2:
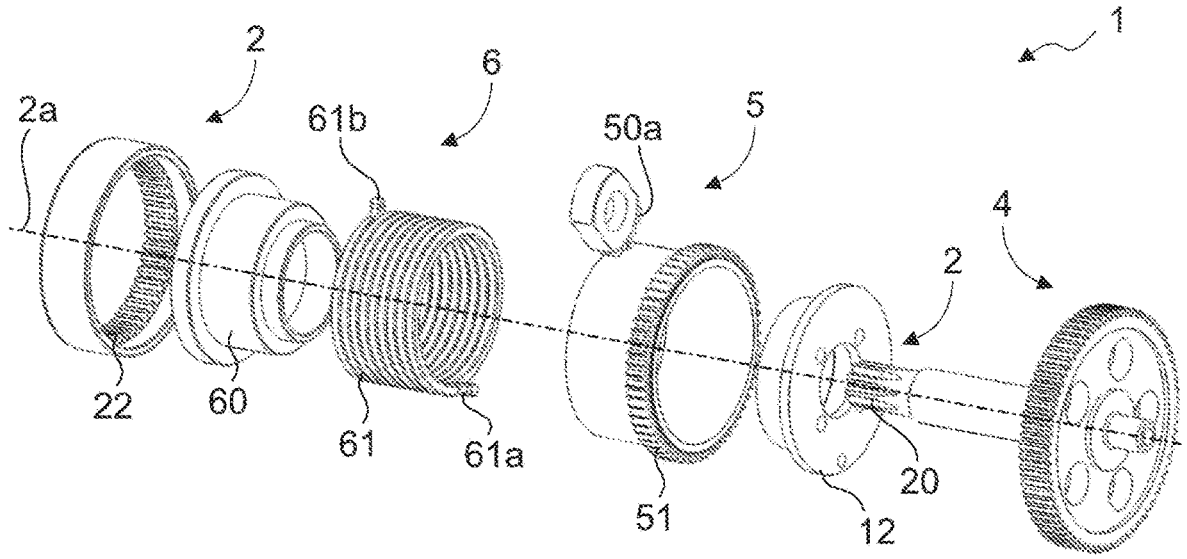
Figure 5A:
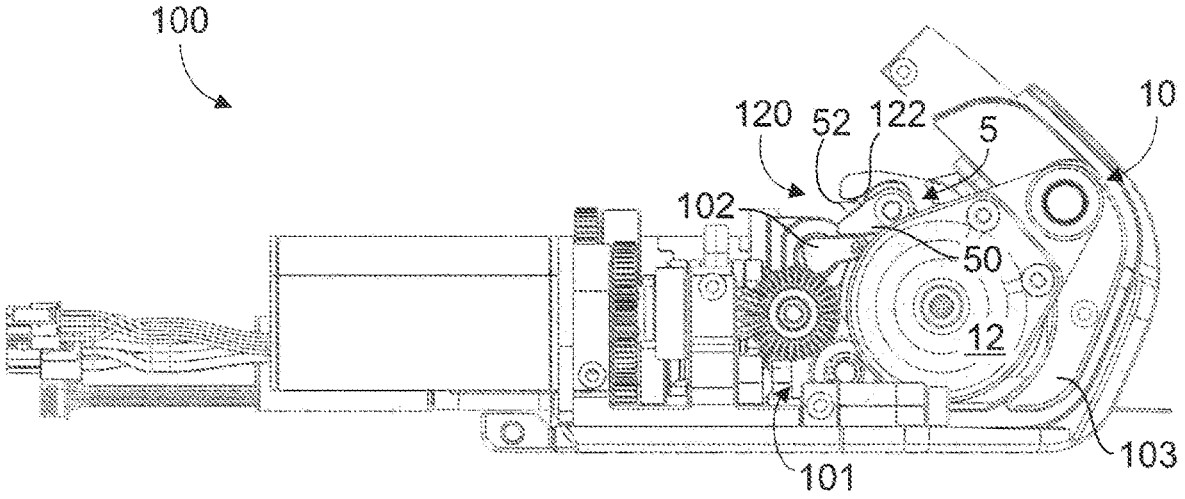
Figure 5B:
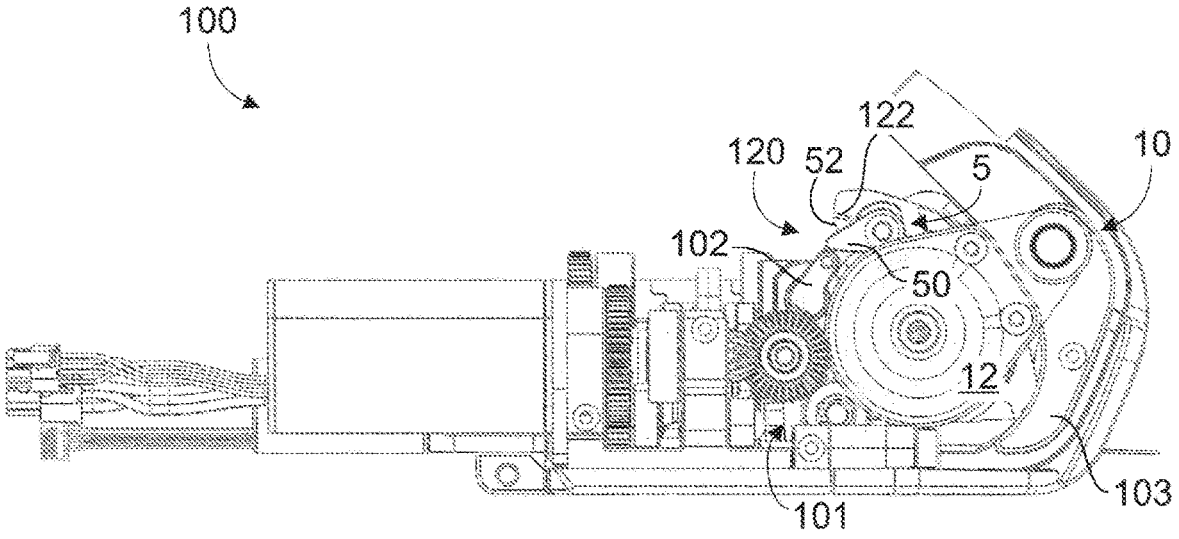

the FIG. 2 illustrates a detail of a control mechanism for tilting device of strapping machine according to the invention;

the FIG. 3 is a perspective view from the rear of a strapping machine comprising a control mechanism for tilting device according to the invention;

the FIG. 4 is a side view of a strapping machine comprising a control mechanism for tilting device of strapping machine according to the invention with tilting device moved closer to the support zone of the strapping machine;

the FIG. 5*a* shows a side view of a strapping machine comprising control mechanism for tilting device of strapping machine according to the invention in which the actuation lever is in the second position, the control lever is in the actuation position and the tilting machine is lowered;

the FIG. 5*b* illustrates a side view of a strapping machine comprising a control mechanism for tilting device of strapping machine according to the invention in which the actuating lever is in the third position, the control lever is in the actuation position and the tilting device is lifted;

the FIG. 6 is a cross-sectional view of a strapping machine comprising a control mechanism for tilting device of strapping machine according to the invention; and the FIG. 7 represents a strapping machine comprising a control mechanism for tilting device known to the current technical state in which the control lever interferes with a toothed wheel.

DESCRIPTION OF THE PREFERRED EMBODIMENTS

In the present document, the measurements, values, shapes and geometric references (such as perpendicularity and parallelism), when associated with words like "about" or other similar terms such as "approximately" or "substantially", are to be considered as except for measurement errors or inaccuracies due to production and/or manufacturing errors, and, above all, except for a slight divergence from the value, measurements, shape, or geometric reference with which it is associated. For instance, these terms, if associated with a value, preferably indicate a divergence of not more than 10% of the value.

Moreover, when used, terms such as "first", "second", "higher", "lower", "main" and "secondary" do not necessarily identify an order, a priority of relationship or a relative position, but can simply be used to clearly distinguish between their different components.

The measurements and data reported in this text are to be considered, unless otherwise indicated, as performed in the International Standard Atmosphere ICAO (ISO 2533:1975).

With reference to the Figures, the control mechanism for tilting device of strapping machine according to the invention is globally indicated with the number 1.

The mechanism 1 is therefore preferably included inside a tilting device 10.

The tilting device 10 is, at the same time, contained in a strapping machine 100. The strapping machine 100 is substantially an instrument that allows a user, typically an operator, to seal packs by means of elongated elements, or tape, known as strapping.

The straps, widely used in the packaging sector, are polymeric bands designed to surround the object to be packaged in such a way as to seal the packaging.

In particular, the strapping machine 100 is adapted to tension the strap and weld the strap in a predetermined point of the strap itself. In order to carry out the welding and tensioning, the strapping machine is provided with a guide area in which two spaced edges of the strap are arranged and overlapped.

While one of the edges is substantially blocked, the other edge of the strap is moved in such a way as to subject the strap to a desired tension. Subsequently, the opposite portions of the two strap edges are subjected to friction and, due to the effect of the heat produced by the friction, they are mutually welded.

The foregoing description, briefly, of the strapping machine 100 is detailed below in the constructive aspects relevant to the purposes of the invention. In order to realize the strapping machine 100 including the mechanism 1 according to the invention it is good to keep in mind what is already known to the skilled in the art and what is already present in the current state of the art.

An example, in this sense, of a strapping machine similar to the strapping machine 1 is the ITA 27 product marketed by Itatools®. Other similar examples are described in patent applications US-A-2018194497 and EP-A-2285691.

Furthermore, the strapping machine 100 is preferably battery operated, but it could also be powered in a different way, as long as it is functional to the invention.

As is known, the strapping machine 100 preferably comprises a tensioning assembly 101 and a welding unit. Preferably, the tensioning assembly 101 and the welding assembly are constrained to a frame 103. Furthermore, the strapping machine 100 is preferably provided with a body suitable for covering at least part of the tensioning assemblies, the welding assembly and the frame 103.

The frame 103 is preferably a structure suitable for housing the components that make up the strapping machine 100 in such a way to constrain them. Obviously, the frame 103 can be in a single piece, or in several pieces which are in turn mutually constrained.

Therefore, substantially, the frame 103 supports the tensioning assembly 101.

The frame 103 therefore also defines a support area 103*a*. The support area 103*a* is a portion of the frame 103 within which, normally, the strap is subjected to the processing of the strapping machine 100.

Therefore, commonly, the strapping machine 100 also defines a support surface. The support surface is substantially a portion, for example flat or with a low curvature, of the support area 103*a* in which the strap for processing is positioned. Furthermore, the strap itself therefore defines a processing trajectory preferably at least partially aligned with respect to the support surface along which the strap is positioned.

The tensioning assembly 101 preferably comprises each component capable of transmitting the energy or motion necessary for the actuation of the components in contact with the strap.

The tensioning assembly 101 is therefore preferably adapted to control the locking and tensioning of at least part of a strap. Therefore, the tensioning assembly 101 is operationally connected to the tilting device 10.

In particular, essentially, the tensioning assembly 101 including at least one motor 101*a* and a transmission 101*b* configured to move at least part of the tilting device 10, as subsequently described in more detail.

The frame 103 therefore also supports the tilting device 10.

The tilting device 10, as suggested by the term, is an element substantially adapted to tilt, or rather rotate, on command around a predetermined axis. Therefore, preferably, the tilting device 10 defines a tilting axis 1*a*.

The tilting axis 1*a* is preferably the axis around which the tilting frame 10 can rotate with respect to the frame 103 of the strapping machine 100. Preferably, the tilting axis 1*a* is substantially transverse with respect to the processing path of the strap in such a way that, by rotating around the tilting axis 1*a*, the tilting device 10 can rise or fall, or move away from or approach the strap.

The tilting device 10, therefore, comprises at least one tensioning roller 11.

The tensioning roller 11 is substantially an annular component adapted to interact with the strap. The tensioning roller 11, in detail, is adapted to contact the strap in such a way as to pull and tension one end of the strap.

Furthermore, also the tilting device 10 includes at least one support structure 12. The support structure 12 is preferably configured to support the components of the tilting device. Therefore, the support structure 12 is configured to support at least part of the mechanism 1 and of the tensioning roller 11. In other words, the support structure 12 performs in the tilting device 10 the same function that the frame 103 performs in the strapping machine 100.

The structure support 12 is therefore integral with the tilting device 10 and, indeed, determines the movement of the tilting device 10. When the tilting device 10 is rotated around the tilting axis 1*a*, the support structure 12 moves around the tilting axis 1*a*.

Before describing the mechanism 1 in detail, it is important to remember that strapping machines commonly comprise an actuation mechanism adapted to move the tilting device 10 around the tilting axis 1*a*.

For this purpose, as is known, the strapping machine 100 includes a common actuation lever 102. The frame 103, therefore, also supports the actuation lever 102. In particular, the actuation lever 102 is constrained in a compliant way to the frame 103 in such a way as to be able to rotate with respect to the frame 103 around an actuation axis 1*b*. The actuation axis 1*b* is therefore preferably parallel to the tilting axis 1*a*.

The actuation lever 102 is therefore configured to move at least part of the mechanism 1, as better explained later.

What has just been described is substantially common to most of the semi-automatic strapping machines.

The strapping machine 100 and, in particular, the tilting device 10 advantageously comprise a different mechanism.

The mechanism 1 preferably comprises some known components connected to innovative elements.

Among the known elements, the mechanism 1 comprises a epicyclic transmission 2, a pulling mechanism 3 and a tensioning wheel 4.

The epicyclic transmission 2 is adapted to transfer the motion of a component along a plurality of stages. In particular, the epicyclic transmission 2 essentially comprises an internal crown 20, a plurality of intermediate gears 21 and an external crown 22. Furthermore, the epicyclic transmission 2 defines a main axis 2*a*.

The main axis 2*a* is preferably oriented in such a way that the tilting axis 1*a* is parallel to the main axis 2*a*.

Therefore, the principal axis 2*a* is also preferably parallel to the actuation axis 1*b*. As is known, in the epicyclic transmission 2, the inner ring 20 and the external ring 22 are mutually centered and arranged concentrically around the main axis 2*a*. The intermediate gears 21 preferably transfer the motion between the inner crown 20 and the outer crown 22.

Therefore, they are arranged around the inner crown 20 and rotate proportionally to the rotation of the inner crown, possibly moving or moving the outer crown in turn. 22.

The pulling mechanism 3 is preferably operatively connected to the intermediate gears 21 and to the tensioning roller 11.

Furthermore, it is configured to transmit the movement of the internal gears 21 around the main axis 2*a* to the tensioning roller 11.

The pulling mechanism 3 it may substantially include a satellite carrier and at least one transmission element. Therefore, the pulling mechanism 3 can be, at least in part, preferably integrally constrained to the intermediate gears 21, by means of the transmission element, and operatively connected to the tensioning roller 11. The pulling mechanism 3 can therefore include constrained parts, more in detail, to the rotation shaft, or pin, of each intermediate gear 21 so that each intermediate gear 21 can rotate freely around the shaft without moving the transmission element of the pulling mechanism 3 and/or can move the transmission element of the pulling mechanism 3 when rotated with respect to the main axis 2*a*.

The driving device 3 is, as already mentioned, in fact configured to transmit the movement of the internal gears 21 around the main axis 2*a*, directly or preferably indirectly, to the tensioning roller 11.

Therefore, the pulling mechanism 3 drives the tensioning roller 11 rotating about the main axis 2*a* proportionally to the intermediate gears 21.

Figure 1:
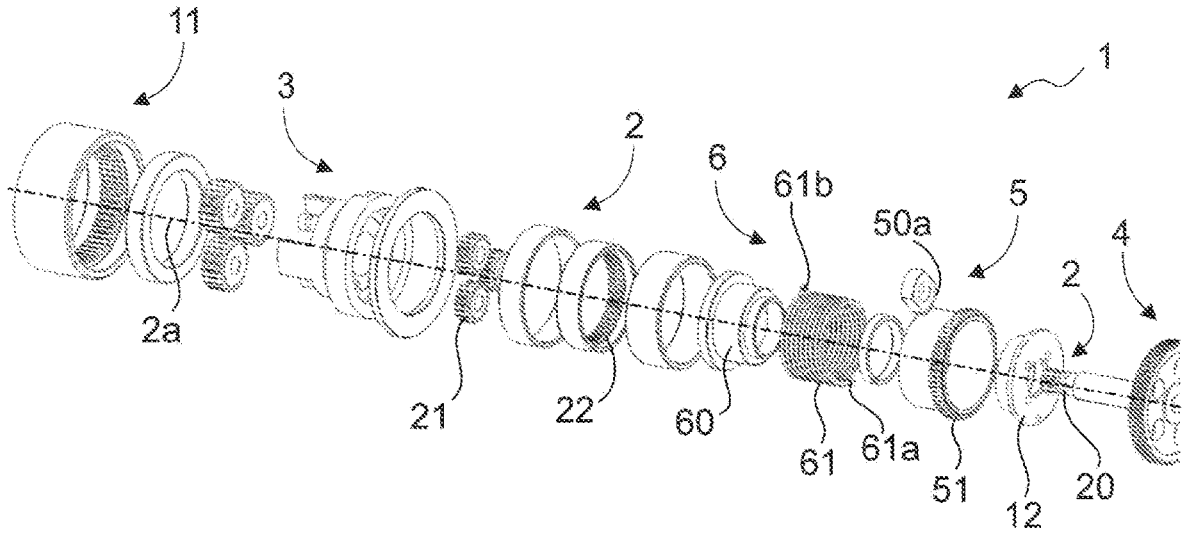

Naturally, the driving device 3 can be directly connected to the tensioning roller 11, or it can be connected to the tensioning roller 11 by means of a reduction mechanism, or second transmission stage, as shown, for example, in FIG. 1. In any case, the tensioning roller 11 and, if present, the reduction mechanism are not part of the mechanism 1, but are terminals to which the control mechanism 1 is connected.

The tensioning wheel 4 is preferably a rotating component adapted to allow the movement, on command, of the tensioning roller 11 in such a way as to put the strap under tension. The tensioning wheel 4, in particular, is the element that allows the motion of the tensioning assembly 101 to be transmitted to the mechanism 1.

The tensioning wheel 4, therefore, is centered with respect to the main axis 2*a*. In addition, preferably, the main axis 2*a* is spaced apart from the tilting axis 1*a* in such a way that the tensioning wheel 4 can be moved at least with respect to two degrees of freedom.

In particular, preferably, the tensioning wheel 4, as well as the tensioning roller 11 to which the tensioning wheel 4 indirectly transmits motion, is able to rotate on itself, in detail around the main axis 2*a*, so that such as to allow the tensioning of a possible strap in contact with the tensioning roller 11 moved by the tensioning wheel 4 and is able to translate along a curvilinear trajectory, substantially an arc of a circle, when the tensioning wheel 4 rotates with respect to the axis of tilting 1*a*.

Basically, therefore, the tilting device 10 is adapted to be moved towards the strap, in such a way as to arrange the tensioning roller 11 in adherence to the strap, or away from the strap.

Naturally, when the tensioning roller 11 adheres to the strap, the tensioning wheel 4 also moves towards the strap integrally with the tensioning roller 11, without touching the strap, since it is a member responsible for transmitting motion.

Therefore, in other words, therefore, the tilting device 10 is adapted to be moved towards the strap, in such a way as to arrange the tensioning wheel 4 close to the strap, or away from the strap.

Furthermore, the tensioning wheel 4 is integrally constrained to the inner crown 20 and operatively connected to the tensioning assembly 101.

In this way, the tensioning wheel 4 transmits its movement, generated by the tensioning assembly 101, to the inner crown 20.

Therefore, when the strapping machine 100 controls the tensioning, the tensioning assembly 101 controls the movement of the tensioning wheel 4, which transmits its motion to the inner crown 20 which, in turn, transmits its motion to the intermediate gears 21, therefore to the transmission element of the driving device 3 and, finally, to the tensioning roller 11.

In order for this transmission to take place, it is necessary to keep the external crown 22 locked.

The external crown 22, therefore, performs a second control independent of the tensioning assembly 101. In fact, when it is intended to instantly detach the rotation of the transmission element of the pulling mechanism 3 upon rotation of the tensioning wheel 4, it is sufficient to free the external crown 22 so that the internal gears 21 begin to rotate around their own axis without rotating around the main axis 2*a*.

This block is usually made with mechanical means as previously described.

The mechanism 1, on the other hand, comprises a locking device 6 and a control device 5.

The control device 5 is preferably configured to interact with the actuation lever 102 of the strapping machine 100. Furthermore, it is operatively connected to the locking device 6 in such a way as to transmit at least part of the motion of the actuation lever 102 to the locking device 6.

In addition, the control device 5 defines at least a rest position and a first actuating position.

In the rest position, of course, the control device 5 is not operated by the actuation lever 102. In the operating position, the control device 5 has performed a first predetermined movement imposed by the actuation lever 102.

The control device 5, more in detail, it comprises at least one control lever 50.

The control lever 50 is substantially constrained in a compliant way to the support structure 12 of the tilting device 10. Furthermore, the control lever 5 is configured to rotate around an axis of rotation 5*a*.

The axis of rotation 5*a* is determined by the constraint between the control lever 50 and the support structure 12. In particular, preferably, the rotation axis 5*a* is parallel to the main axis 2*a*.

In any case, the control lever 50 is configured to rotate around the axis of rotation 5*a* at least during the first predetermined movement, imposed by the actuation lever 102.

The control device 5 therefore also comprises a transmission gear 51.

The transmission gear 51 is preferably centered with respect to the main axis 2*a*. Furthermore, the transmission gear 51 is constrained to part of the locking device 6, as better specified below.

The transmission gear 51 therefore includes at least a portion adapted to interact with the control lever 50. In turn, the control lever 50 includes a toothed portion 50*a*. The toothed portion 50*a* is preferably operatively connected to the transmission gear 51. In this way the toothed portion 50*a* transmits the first predetermined movement around the axis of rotation 5*a* to the transmission gear 51. The transmission gear 51 rotates, therefore, around the main axis 2*a* with respect to fixed points of the tilting device 10, or rather the points present on the support structure 12.

The control device 5 is not only adapted to move part of the locking device 6 in proportion to the movement imposed by the actuation lever 102, but is also adapted to allow the movement of the tilting device 10, and therefore of the support structure 12, of the mechanism 1 and of the tensioning roller 11 around the tilting axis 1*a*. In this regard, in particular, the support structure 12 comprises a guide 120 and the control lever comprises a slider 52.

The guide 120 is substantially given a cavity within which the slider 52 can move in a controlled manner. Therefore, the guide 120 preferably defines a first end 121 and a second end 122.

The ends 121, 122 are substantially the limits within which the slider 52 can move. The slider 52 is therefore configured to pass from the first end 121 to the second end 122 when the control device 5 passes from the rest position to the actuation position.

The actuation lever 102 is therefore configured to move the support structure 12 around the tilting axis 1*a* by leveraging the slider 52 locked at the second end 122.

Preferably, the slider 52 is arranged near the end of the control lever 50 configured to interfere with the operating lever 102. In this way, when the actuation lever 102 leverages the control lever 50 to raise the tilting device 10, the lever point is arranged near the slider 52 and, even more in detail, near the second end 122.

Therefore, the control device 5 allows the actuation lever 102 to basically define three relevant positions.

The actuation lever 102 defines a first position, a second position and a third position.

In a first position the actuation lever 102 does not interfere with the control device 5 and the control device 5 is in the rest position.

In the second position, the actuation lever 102 interferes with the control device 5, the control device 5 is in the actuation position and the tilting device 10 is arranged near the support area 103*a*, in particular it is attached to a strap.

In the third position, the actuation lever 102 interferes with the control device 5, the control device 5 is in the actuation position and the tilting device 10 is moved away from the support portion 103*a* in such a way as to free the strap.

Therefore, preferably, the actuation lever 102 is configured to move the tilting device 10 around the tilting axis 1*a* exclusively by passing from the second position to the third position and vice versa.

All movements of the actuation lever 102 are performed around the actuation axis 1*b*. Furthermore, preferably, the first, second and third positions are reached in sequence from the first to the third and from the third to the first.

Therefore, the slider 52 passes from the first end 121 to second end 122 when the control device 5 passes from the rest position to the actuation position, or rather, when the actuation lever 102 passes from the first position to the second position The movement of the tilting device 10 occurs furthermore, in opposition to the opposition means 104.

Therefore, the strapping machine 100 comprises the opposition means 104. The opposition means 104 are preferably elastic and are arranged between the frame 103 and the support structure 12.

In particular, they are configured to oppose the movement of the frame 10 around the tilting axis 1*a* when the actuation lever 102 passes from the second to the third position.

In this way, when the actuation lever 102 returns to the second position, from the third position, the tilting device 10 is pushed towards the strap on the support area 103*a*.

The locking device 6, configured to interact with the control device 5, is preferably operatively connected to the external crown 22.

Furthermore, the locking device 6 is preferably configured to provide at least one lock condition and an unlock condition.

In the locked condition, the locking device 6 and the external crown 22 are coupled so as to provide an integral constraint. In the unlocked condition, at least part of the locking device 6 and the external crown 22 are decoupled in such a way that they can be moved independently.

These conditions are achieved by particular advantageous measures.

The locking device 6 in fact comprises a ring 60 and a torsional spring 61.

The ring 60 is preferably centered with respect to the main axis 2*a* and is integral with the external crown 22. Therefore, the movement of the external crown 22 is dependent on the movement of the ring 60 as well.

The torsional spring 61 is preferably constrained between a fixed point of the tilting device 10 and the control device 5.

Basically, the fixed point is any point of the support structure 12, or rather the fixed structure of the tilting device 10 which can be moved exclusively around the tilting axis 1*a*.

The torsional spring 61 is therefore centered with respect to the main axis 2*a* and is configured to tighten around the ring 60 to achieve the locking condition or to widen around the ring 60 in such a way as to achieve the release condition.

In other words, by reducing or expanding radially around the main axis 2*a*, the torsional spring 61 creates or does not create a friction force on the walls of the ring 60 which oppose its rotation and block or not the outer crown 22.

Even more in detail, the torsional spring 61 defines a first end 61*a* and a second end 61*b*.

The first end 61*a* is integral with the fixed point on the receiver 10, that is to any point of the support structure 12.

Therefore, the fixed point of the receiver 10 is defined by the constraint point between the first end 61*a* and the support structure 12 on the tilting device 10.

The second end 61*b* is integral with at least part of the control device 5.

In this way, when the control device 5 passes from the rest position to the operating position, the ends 61*a*, 61*b* are mutually moved so that the lock 6 steps from the lock condition to the unlock condition.

Obviously, if the device 5 passes from the actuation position to the rest position, the lock device 6 passes from the unlocked condition to the locked condition.

Even more in detail, the second end 61*b* is constrained to the transmission gear 51. In this way, a rotation of the transmission gear 51, controlled by the toothed portion 51*a* when the actuation lever 102 passes from the first to the second position and the control lever 50 rotates around the rotation axis 2*a* so that the control device 5 passes from the rest position to the actuation position, corresponding to a rotation of the second end 61*b* about the main axis 2*a*.

Therefore, when the transmission gear 51 rotates around the main axis 2*a* with respect to the fixed point on the tilting device 10, it drags the second end 61*b*.

Certainly, ring 60, torsional spring 61 and transmission gear 51 can be configured in various ways. Preferably, in the preferred but not exclusive embodiment, the transmission gear 51, the ring 60 and the torsional spring 61 are arranged concentrically and the transmission gear 51 surrounds the torsional spring 61 in such a way as to cover it.

The operation of the mechanism 1 previously described in structural terms is as follows.

Basically, the mechanism 1 allows to unlock the rotation of the tensioning roller 11 with respect to the rotation of the tensioning wheel 4 as soon as the strapping machine 100 commands the detachment of the tilting machine 10 from the strap. In fact, the actuation lever 102 passes from the first to the second position, before reaching the third, making the control device 5 pass from the rest position to the actuation position.

In the drive position, the transmission gear 51 is rotated, the torsional spring 61 is dilated on the ring 60 and the ring 60 is released allowing the external crown 22 to rotate proportionally to the intermediate gears 21.

The intermediate gears 21, therefore, rotate around their own axis and the rotation around the main axis 2*a* of the transmission element of the pulling mechanism 3 is released from the rotation of the tensioning wheel 4, or rather of the inner crown 20, so that the tensioning roller 11 is also unlocked or released with respect to the rotation of the internal crown 20. In this way, the satellites of the second stage being stationary, that is the gears of the reduction mechanism, because they are integral with the transmission element of the pulling mechanism 3, the tensioning roller 11 can rotate in the reverse direction, around the main axis 2*a*, to the direction of rotation in strapping traction and thus release the tension to be able to open the tilting device 10.

a unidirectional in the wheel 4 which blocks this direction of rotation.

The mechanism 1 according to the invention achieves important advantages.

In fact, the control mechanism 1 for the strapping device allows to reduce or completely eliminate the possibility of slippage between the control lever and the locking gear.

Another important advantage of the invention is given by the fact that the mechanism 1 increases the response speed of the tilting device 10 to the commands given by a user to the strapping machine 100 which involve the locking or movement of the tilting device 10 itself.

Furthermore, the mechanism 1 avoids the use of double-toothed crowns and can be easily installed on common strapping machines since it is able to collaborate efficiently with components such as tensioning unit 101, actuation lever 102, tensioning roller 11 and obstruction means 104 of common conception avoiding major structural modifications of the strapping machine 100.

The invention is susceptible of variants falling within the scope of the inventive concept defined by the claims.

In this context, all the details can be replaced by equivalent elements and the materials, shapes and dimensions can be any.

The invention claimed is:

1. A control mechanism for a tilting device of a strapping machine comprising:

an epicyclic transmission defining a main axis and comprising an inner crown, a plurality of intermediate gears and an external crown, a pulling mechanism operatively connected to said intermediate gears and to a tensioning roller of said tilting device and configured to transmit a movement of said intermediate gears around said main axis to said tensioning roller, a tensioning wheel centred with respect to said main axis integrally constrained to said inner crown and operatively connected to a tensioning assembly of said strapping machine in such a way as to transmit a movement of said tensioning wheel imposed by said tensioning assembly to said inner crown, a locking device operationally connected to said external crown and configured to realize at least:

a lock condition in which said locking device and said external crown are coupled in such a way as to create a constraint joint, an unlock condition wherein at least part of said locking device and said external crown are decoupled in such a way as to be movable independently, a control device configured to interact with an actuation lever of said strapping machine, operatively connected to said locking device in such a way as to transmit at least part of the movement of said actuation lever to said locking device, and defining at least one resting position and a first actuation position wherein said control device has performed a first predetermined movement imposed by said actuation lever, said locking device including:

a ring centred with respect to said main axis and integral with said external crown, and a torsional spring constrained between a fixed point of said tilting device and said control device, said torsional spring being centred with respect to said main axis and configured to tighten around said ring to realize said lock condition or widen around said ring in such a way as to realize said unlock condition.

2. The control mechanism according to claim 1, wherein said torsional spring defining a first head integral with said fixed point to said tilting device and a second head integral with at least part of said control device in such a way that when said control device passes from said resting position to said first actuation position and vice versa, said heads are reciprocally moved so that said locking device passes from said lock condition to said unlock condition and vice versa.

3. The control mechanism according to claim 2, wherein said control device defines an axis of rotation parallel to said main axis and includes at least one control lever configured to rotate around to said axis of rotation at least during said first predetermined movement and a transmission gear centred with respect to said main axis and constrained to said second head, said control lever including a toothed portion operatively connected to said transmission gear so as to transmit said first predetermined movement around said axis of rotation to said transmission gear so that said transmission gear rotates around said main axis with respect to said fixed point on said tilting device by dragging said second head.

4. The control mechanism according to claim 3, wherein said transmission gear, said ring and said torsional spring are arranged concentrically and said transmission gear surrounds said torsional spring in such a way as to cover said torsional spring.

5. A tilting device of a strapping machine comprising, a control mechanism, the control mechanism comprising:

an epicyclic transmission defining a main axis and comprising an inner crown, a plurality of intermediate gears and an external crown, a pulling mechanism operatively connected to said intermediate gears and to a tensioning roller of said tilting device and configured to transmit a movement of said intermediate gears around said main axis to said tensioning roller, a tensioning wheel centred with respect to said main axis integrally constrained to said inner crown and operatively connected to a tensioning assembly of said strapping machine in such a way as to transmit a movement of said tensioning wheel imposed by said tensioning assembly to said inner crown, a locking device operationally connected to said external crown and configured to realize at least:

a lock condition in which said locking device and said external crown are coupled in such a way as to create a constraint joint, an unlock condition wherein at least part of said locking device and said external crown are decoupled in such a way as to be movable independently, a control device configured to interact with an actuation lever of said strapping machine, operatively connected to said locking device in such a way as to transmit at least part of the movement of said actuation lever to said locking device, and defining at least one resting position and a first actuation position wherein said control device has performed a first predetermined movement imposed by said actuation lever, said locking device including:

a ring centred with respect to said main axis and integral with said external crown, and a torsional spring constrained between a fixed point of said tilting device and said control device, said torsional spring being centred with respect to said main axis and configured to tighten around said ring to realize said lock condition or widen around said ring in such a way as to realize said unlock condition, wherein said torsional spring defining a first head integral with said fixed point to said tilting device and a second head integral with at least part of said control device in such a way that when said control device passes from said resting position to said first actuation position and vice versa, said heads are reciprocally moved so that said locking device passes from said lock condition to said unlock condition and vice versa, and wherein said tensioning roller centred with respect to said main axis and a support structure configured to support at least part of said mechanism and said tensioning roller, said first head being constrained to said support structure and said fixed point of said tilting device being defined by the constraint point between said first head and said support structure on said tilting device.

6. The tilting device according to claim 5, wherein said control device defines an axis of rotation parallel to said main axis and includes at least one control lever configured to rotate around to said axis of rotation at least during said first predetermined movement and a transmission gear centred with respect to said main axis and constrained to said second head, said control lever including a toothed portion operatively connected to said transmission gear so as to transmit said first predetermined movement around said axis of rotation to said transmission gear so that said transmission gear rotates around said main axis with respect to said fixed point on said tilting device by dragging said second head.

7. The tilting device according to claim 6, wherein said transmission gear, said ring and said torsional spring are arranged concentrically and said transmission gear surrounds said torsional spring in such a way as to cover said torsional spring.

8. A strapping machine comprising a tilting device including a control mechanism, the control mechanism comprising:

an epicyclic transmission defining a main axis and comprising an inner crown, a plurality of intermediate gears and an external crown, a pulling mechanism operatively connected to said intermediate gears and to a tensioning roller of said tilting device and configured to transmit a movement of said intermediate gears around said main axis to said tensioning roller, a tensioning wheel centred with respect to said main axis integrally constrained to said inner crown and operatively connected to a tensioning assembly of said strapping machine in such a way as to transmit a movement of said tensioning wheel imposed by said tensioning assembly to said inner crown, a locking device operationally connected to said external crown and configured to realize at least:

a lock condition in which said locking device and said external crown are coupled in such a way as to create a constraint joint, an unlock condition wherein at least part of said locking device and said external crown are decoupled in such a way as to be movable independently, a control device configured to interact with an actuation lever of said strapping machine, operatively connected to said locking device in such a way as to transmit at least part of the movement of said actuation lever to said locking device, and defining at least one resting position and a first actuation position wherein said control device has performed a first predetermined movement imposed by said actuation lever, said locking device including:

a ring centred with respect to said main axis and integral with said external crown, and a torsional spring constrained between a fixed point of said tilting device and said control device, said torsional spring being centred with respect to said main axis and configured to tighten around said ring to realize said lock condition or widen around said ring in such a way as to realize said unlock condition, wherein said torsional spring defining a first head integral with said fixed point to said tilting device and a second head integral with at least part of said control device in such a way that when said control device passes from said resting position to said first actuation position and vice versa, said heads are reciprocally moved so that said locking device passes from said lock condition to said unlock condition and vice versa, wherein said tensioning roller centred with respect to said main axis and a support structure configured to support at least part of said mechanism and said tensioning roller, said first head being constrained to said support structure and said fixed point of said tilting device being defined by the constraint point between said first head and said support structure on said tilting device, and wherein said tensioning assembly including at least one motor and a transmission configured to move said tensioning wheel on command, said actuation lever configured to move on command from said control device and a frame configured to support said tilting device, said tensioning assembly and said actuation lever and defining a support area configured to house part of a strap, said tilting device being constrained in a compliant way to said frame in such a way as to be able to rotate with respect to said frame around a tilting axis parallel to said main axis, said actuation lever being constrained in a compliant way to said frame in such a way as to be able to rotate with respect to said frame around an actuation axis parallel to said main axis.

9. The strapping machine according to claim 8, wherein said actuation lever defines at least:

a first position wherein said actuation lever does not interfere with said control device and said control device is in the resting position, a second position in which said actuation lever interferes with said control device, said control device is in operating position and said tilting device is close to said support area in adhesion with said strap, a third position in which said actuation lever interferes with said control device, said control device is in actuation position and said tilting device is moved away from said support area, and said actuation lever is configured to move said tilting device around said tilting axis exclusively by passing from said second position to said third position and the other way around.

10. The strapping machine according to claim 9, wherein said support structure comprises a guide defining a first end and a second end, said control device comprises a slider configured to pass from said first end to said second end when said control device passes from said resting position to said actuation position and said actuation lever passes from said first position to said second position, and said actuation lever is configured to move said support structure around said tilting axis by leveraging said slider locked in correspondence of said second end.

11. The strapping machine according to claim 8, wherein said control lever includes a slider and said slider is arranged in proximity of an end of said control lever configured to interfere with said actuation lever.

12. The strapping machine according to claim 8, comprising opposition means that are elastic arranged between part of said frame and said support structure configured to oppose the movement of said tilting device around said tilting axis when said actuation lever passes from said second position to said third position in such a way that, when said actuation lever returns to said second position, said tilting device is pushed towards said strap on said support area.

13. The strapping machine according to claim 8, wherein said control device defines an axis of rotation parallel to said main axis and includes at least one control lever configured to rotate around to said axis of rotation at least during said first predetermined movement and a transmission gear centred with respect to said main axis and constrained to said second head, said control lever including a toothed portion operatively connected to said transmission gear so as to transmit said first predetermined movement around said axis of rotation to said transmission gear so that said transmission gear rotates around said main axis with respect to said fixed point on said tilting device by dragging said second head.

14. The strapping machine according to claim 13, wherein said transmission gear, said ring and said torsional spring are arranged concentrically and said transmission gear surrounds said torsional spring in such a way as to cover said torsional spring.

* * * * *